US006158670A

United States Patent [19]

Blocker

[11] Patent Number: 6,158,670

[45] Date of Patent: Dec. 12, 2000

[54] FIRE HOSE HARNESS ASSEMBLY

[76] Inventor: William K. Blocker, 1416-F1 Farrington Way, Columbia, S.C. 29210

[21] Appl. No.: 09/384,014

[22] Filed: Aug. 26, 1999

[51] Int. Cl.[7] ..... B05B 9/08; A62C 15/00

[52] U.S. Cl. ..... 239/153; 239/152; 239/589; 169/52; 248/75; 224/259

[58] Field of Search ..... 239/152, 153, 239/569, 589, 525, 530, 531; 248/75; 169/52, 48; 224/250, 259, 261, 262; 222/175

[56] References Cited

U.S. PATENT DOCUMENTS

| | | | |
|---|---|---|---|
| 612,035 | 10/1898 | Hammerle | 239/153 |
| 830,606 | 9/1906 | Lovett . | |
| 3,223,172 | 12/1965 | Moss | 239/152 |
| 3,275,205 | 9/1966 | Howd et al. . | |
| 4,762,257 | 8/1988 | Spillers et al. . | |
| 4,858,797 | 8/1989 | Rabska . | |
| 5,110,023 | 5/1992 | Colin . | |
| 5,137,094 | 8/1992 | Broussard | 169/52 X |
| 5,195,596 | 3/1993 | Mount, III et al. | 169/52 |
| 5,433,288 | 7/1995 | James . | |

*Primary Examiner*—Andres Kashnikow
*Assistant Examiner*—Steven J. Gangy
*Attorney, Agent, or Firm*—Kenneth L Tolar

[57] ABSTRACT

A harness assembly for assisting a user in transporting a fire hose includes an adjustable strap assembly secured to a chest plate. The device is secured to a wearer with the chest plate positioned on the chest and abdomen. Attached to the chest plate is a nozzle assembly including a manifold portion that is disposed adjacent the wearer's side which may be coupled with the outlet of a fire hose. The nozzle assembly further includes an intermediate section perpendicularly extending from the manifold portion and a dispensing portion perpendicularly extending from the intermediate section and away from the user. The dispensing portion includes a water control valve, a clip for attaching the nozzle assembly to the chest plate and a pair of diametrically opposed handles which may be grasped by a user. The unique design of the nozzle assembly allows a user to maintain the hose at his or her side while being able to dispense water therefrom at a point directly in front of the user for enhanced control.

6 Claims, 2 Drawing Sheets

FIRE HOSE HARNESS ASSEMBLY

BACKGROUND OF THE INVENTION

The present invention relates to a harness assembly that allows a firefighter to transport a fire hose without occupying the firefighter's hands.

DESCRIPTION OF THE PRIOR ART

Firefighters often must climb ladders and crawl within confined spaces or beneath a smoke cloud when fighting a fire. In addition to carrying tools, the firefighter must carry a fire hose which occupies one or both hands. Holding a fire hose while ascending a ladder or crawling can be extremely cumbersome and difficult. Although several devices have been developed to assist a firefighter in transporting a fire hose, they are structurally complex and only assist the wearer in carrying the hose. The present invention solves the above enumerated problems by providing a harness assembly having a uniquely configured dispensing nozzle attached thereto. A fire hose may be coupled with the dispensing nozzle whereby the fire hose is then supported on the user's shoulders thereby freeing the hands for other tasks. The uniquely designed nozzle allows the hose to be supported at one's side while providing a water outlet immediately in front of the user for enhanced control. Various shoulder harnesses and similar devices for fire hoses exist in the prior art. For example, U.S. Pat. No. 5,433,288 issued to James discloses a fire fighting hose harness including a strap attachable to hooks on the hose.

U.S. Pat. No. 5,110,023 issued to Colin discloses a carrier for pool vacuum hoses including a shoulder loop and a variable size hose carrying loop.

U.S. Pat. No. 4,858,797 issued to Rabska discloses a backpack frame for transporting spirally coiled fire hoses.

U.S. Pat. No. 4,762,257 issued to Spillers et al. discloses a hose handler including a detachable chest belt supported by a pair of shoulder straps having means for securing a fire hose thereto.

U.S. Pat. No. 3,275,205 issued to Howd et al. discloses a strap for rescue, carrying, and emergency use. The device includes a strap constructed with high nylon webbing which is looped together in a certain designated pattern and stitched for the purpose of making loops and handles.

U.S. Pat. No. 830,606 issued to Lovett discloses a firefighter's belt including a strap with a hook at one end and a buckle at the other end. The strap includes various hooks and loops to which tools may be secured.

The present invention provides a unique fire hose harness having a dispensing portion that affords a wearer greater control over the hose.

SUMMARY OF THE INVENTION

The present invention relates to a harness assembly that allows a user to support a fire hose on the user's shoulders. The device comprises a chest plate having a pair of shoulder cuffs extending therefrom. A length adjustable strap assembly is attached to the shoulder cuffs for securing the chest plate to a wearer. Attached to a side edge of the chest plate is a nozzle assembly including a manifold portion for coupling with the end of a fire hose. Perpendicularly extending from the manifold portion and adjacent the chest plate is an intermediate section, with a dispensing portion extending perpendicularly therefrom. The dispensing portion includes diametrically opposed handles, a water control valve and a dispensing nozzle. The dispensing portion also includes a clip which may be attached to a ring on the chest plate allowing the user to secure the hose assembly in an upright position. It is therefore an object of the present invention to provide a harness assembly that allows a fire hose to be supported on a user's shoulders.

It is another object of the present invention to provide a harness assembly that allows a user to support a fire hose at his or her side without occupying the user's hands.

It is yet another object of the present invention to provide a harness assembly for supporting a fire hose that includes a flow controllable dispensing nozzle.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
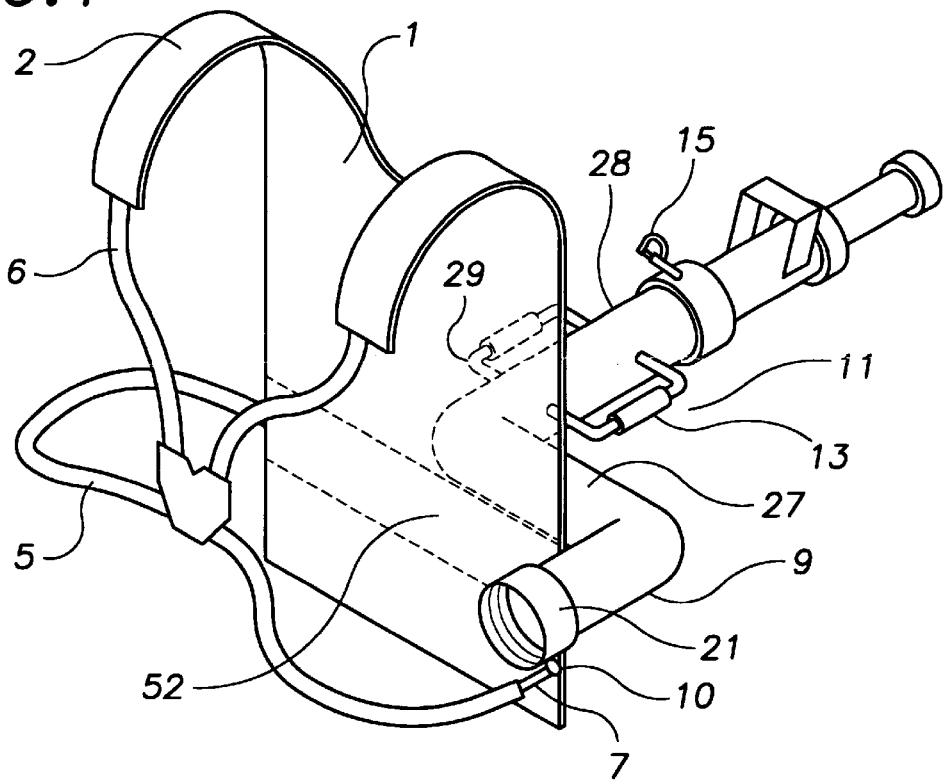
FIG. 1 is a perspective view of the harness assembly.
Figure 2:
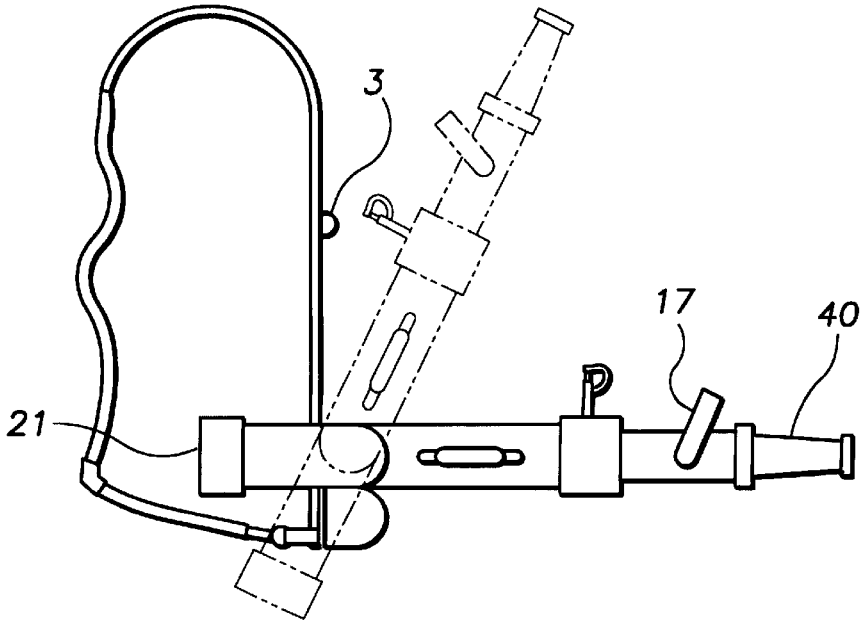
FIG. 2 is a side view of the harness assembly.

Referring, now to FIGS. 1 through 4, the present invention relates to a harness assembly for assisting a wearer in transporting and operating a fire hose. The device comprises a chest plate 1 having a pair of shoulder cuffs 2 extending from the upper edge thereof. On the front surface of the chest plate is a locking ring 3. An adjustable strap assembly includes a pair of back straps 6, each having a first end attached to a designated shoulder cuff. The opposing end of each back strap is attached to a waist strap 5. The waist strap 5 is secured at one end to a side edge of the chest plate. The other end includes a releaseable clip 7 for removably securing to a nozzle assembly, described in more detail below.

Hingedly mounted to the front surface of the chest plate is a nozzle assembly. The nozzle assembly includes a manifold portion 9 having an internally threaded sleeve 21 mounted on an end thereof for coupling with a fire hose outlet. The manifold portion also includes a hook 10 to which the clip on the waste strap may be secured.

Perpendicularly extending from the opposing end of the manifold portion is an intermediate section 27 that is disposed adjacent the front surface of the chest plate and is joined thereto with a hinge 50 that allows the entire nozzle assembly to be pivoted relative to the chest plate. Perpendicularly extending from the intermediate section and away from the chest plate is a dispensing portion 28. The dispensing portion includes a pair of diametrically opposed handle members 11 which may be grasped by a user. Each handle is U-shaped and includes a central portion 29 surrounded by a sleeve 13. The sleeve is constructed with rubber, foam or similar material for providing a comfortable gripping surface. A releaseable clip 15 similar to that on the waist strap is attached to the dispensing portion which may be selectively coupled with the locking ring on the chest plate to secure the nozzle assembly in an upright position. The dispensing portion also includes a nozzle 40 through which water from the hose exits.

Figure 3:
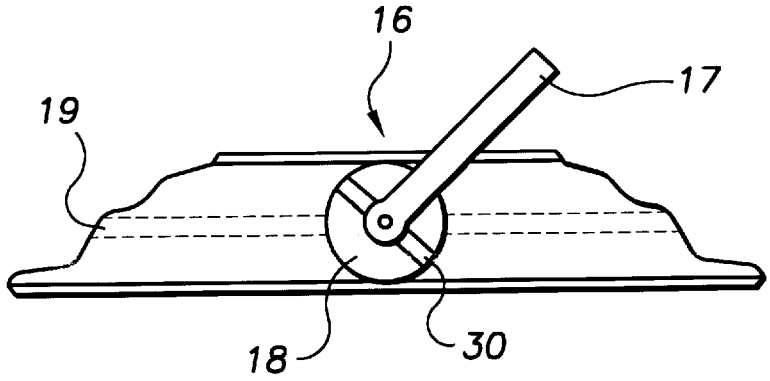
FIG. 3 is a detailed view of the water control valve assembly.
Figure 4:
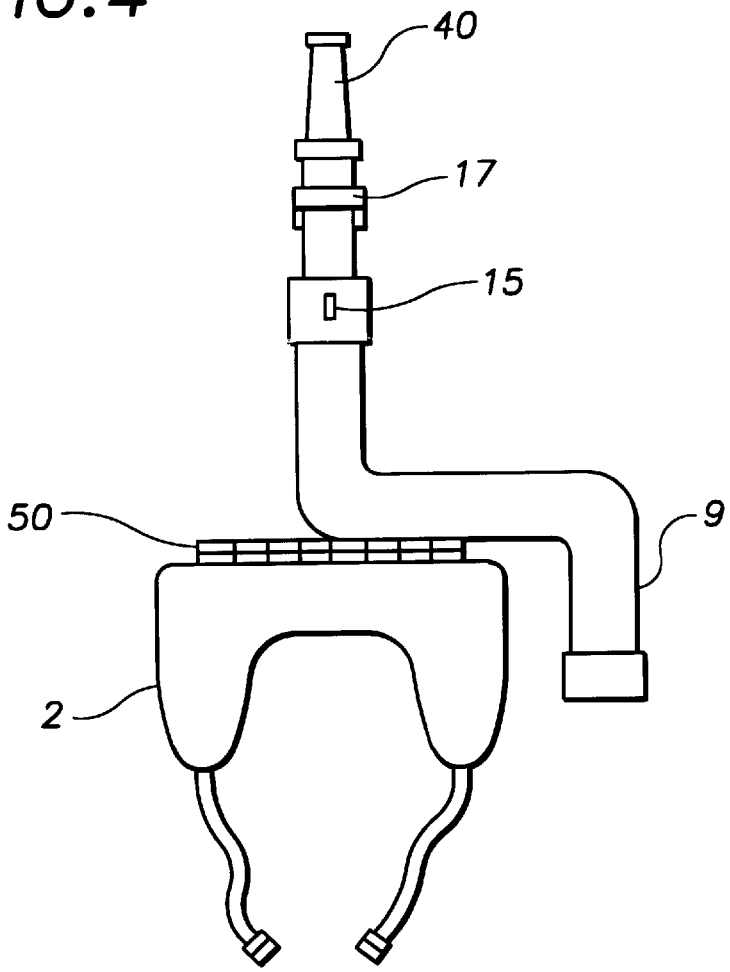
FIG. 4 is a top view of the harness assembly.

The dispensing portion also includes a ball valve 16 operable with a pivotable lever 17. As depicted in FIG. 3, the lever operates an attached, internally disposed ball 18 having a bore 30 therethrough. When the lever is placed in a first position, the bore aligns with a channel 19 within the ball valve housing to allow liquid flow to flow therethrough. When the handle is placed in a second position, the bore is misaligned with the channel thereby preventing flow. At distal end of the dispensing portion is a dispensing nozzle through which water from the hose exits. When the device is being worn, the dispensing nozzle is immediately in front of the wearer's torso.

On the front surface of the chest plate is an alignment band 52 that is substantially aligned with the nozzle assembly when the nozzle assembly is in a lowered position. The alignment band assists a user in adjusting the back and waist straps to position the nozzle at a desired position on the wearer's torso.

As is readily apparent from the above description, the present invention provides a harness assembly that allows a user to conveniently transport a fire hose without occupying the hands. Furthermore, the uniquely designed nozzle assembly allows the wearer to maintain the hose at his or her side while having the hose outlet directly in front for greater control.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A harness assembly for assisting a user in transporting a fire hose comprising:

a chest plate;

a strap assembly attached to said chest plate for securing said chest plate to a wearer;

a nozzle assembly attached to said chest plate, said nozzle assembly including a first end adapted to be coupled with a fire hose outlet and a second end through which water from the fire hose is dispensed.

2. A harness assembly according to claim 1 wherein said nozzle assembly further comprises:

a manifold portion that is coupled with said fire hose and positioned adjacent a wearer's side;

an intermediate section perpendicularly extending from said manifold section that is attached to said chest plate;

a dispensing portion perpendicularly extending from said intermediate section and away from said chest plate whereby the hose is conveniently supported adjacent a wearer's side while water from the hose can be dispensed from a point immediately in front of the wearer.

3. A harness assembly according to claim 1 wherein said nozzle assembly further includes a valve for selectively regulating water flow therethrough.

4. A harness assembly according to claim 1 further comprising:

a clip attached to said nozzle assembly that can be removably coupled to a ring on said chest plate to secure said nozzle assembly in an upright position.

5. A harness assembly according to claim 1 wherein said nozzle assembly includes a pair of diametrically opposed handle members thereon which can be grasped by a user to control said nozzle assembly.

6. A harness assembly according to claim 1 wherein said nozzle assembly is hingedly attached to said chest plate allowing said nozzle assembly to pivot relative thereto.

* * * * *